US010184294B2

(12) United States Patent
Östling

(10) Patent No.: US 10,184,294 B2
(45) Date of Patent: Jan. 22, 2019

(54) ROCK DRILLING MACHINE AND USE THEREOF FOR HINDERING OCCURRENCE AND SPREADING OF CAVITATION BUBBLES

(75) Inventor: Thomas Östling, Eskilstuna (SE)

(73) Assignee: Epiroc Rock Drills Aktiebolag, Orebro (SE)

( * ) Notice: Subject to any disclaimer, the term of this patent is extended or adjusted under 35 U.S.C. 154(b) by 1156 days.

(21) Appl. No.: 13/261,395

(22) PCT Filed: Mar. 28, 2011

(86) PCT No.: PCT/SE2011/050342

§ 371 (c)(1),
(2), (4) Date: Aug. 8, 2012

(87) PCT Pub. No.: WO2011/123028

PCT Pub. Date: Oct. 6, 2011

(65) Prior Publication Data

US 2012/0305280 A1 Dec. 6, 2012

(30) Foreign Application Priority Data

Apr. 1, 2010 (SE) ..... 1050317

(51) Int. Cl.

| | |
|---|---|
| ***E21B 1/02*** | (2006.01) |
| ***B25D 17/06*** | (2006.01) |
| ***B25D 17/24*** | (2006.01) |

(52) U.S. Cl.

CPC ..... *E21B 1/02* (2013.01); *B25D 17/06* (2013.01); *B25D 17/245* (2013.01); *B25D 2217/0019* (2013.01)

(58) Field of Classification Search

CPC ..... E21B 1/02; B25D 17/06; B25D 17/245; B25D 2217/0019

USPC ..... 173/200, 211

See application file for complete search history.

(56) References Cited

U.S. PATENT DOCUMENTS

| | | | | |
|---|---|---|---|---|
| 3,699,675 | A | 10/1972 | Galle | |
| 3,815,766 | A * | 6/1974 | Carlson | F15B 11/20 212/286 |
| 3,965,799 | A * | 6/1976 | Juvonen | B25D 9/145 91/220 |
| 4,062,411 | A | 12/1977 | Adkins et al. | |
| 4,282,937 | A * | 8/1981 | Hibbard | B25D 9/12 173/1 |
| 4,852,664 | A * | 8/1989 | Terada | B25D 9/12 173/206 |
| 4,945,998 | A | 8/1990 | Yamanaka | |

(Continued)

FOREIGN PATENT DOCUMENTS

| | | | |
|---|---|---|---|
| CN | 1045551 | A | 9/1990 |
| CN | 1231379 | A | 10/1999 |

(Continued)

*Primary Examiner* — Robert Long
(74) *Attorney, Agent, or Firm* — Mark P. Stone

(57) ABSTRACT

Rock drilling machine (10) comprising a piston that is arranged to move back and forth in a chamber (12*a*, 12*b*) when the rock drilling machine (10) is in use, a cavitation-sensitive component (14), and an oil channel that is arranged to extend between the chamber (12*a*, 12*b*) and said cavitation-sensitive component (14). The oil channel comprises a series of restrictions (18) and oil volumes (20) to hinder the movement of cavitation bubbles through said oil channel.

20 Claims, 1 Drawing Sheet

(56) References Cited

U.S. PATENT DOCUMENTS 5,085,617 A * 2/1992 Stretch ..... F16F 15/1213 192/207
5,131,430 A * 7/1992 Roeske ..... B62D 5/083 137/625.23
5,377,781 A * 1/1995 Yun ..... F04B 39/0246 184/6.23
5,852,262 A * 12/1998 Gill ..... G01V 1/48 181/102
5,921,275 A * 7/1999 Knop ..... F16K 31/404 137/498
6,206,101 B1 * 3/2001 Bakke ..... E21B 23/04 166/301
6,244,297 B1 6/2001 Baumann
6,568,477 B1 5/2003 Dveyrin
6,699,087 B1 3/2004 Tafoya et al.
8,047,302 B2 * 11/2011 Berger et al. ..... 173/1
2004/0195062 A1 * 10/2004 Anderfaas ..... F16F 9/535 188/267.2
2005/0034881 A1 * 2/2005 Berger et al. ..... 173/2
2005/0115040 A1 * 6/2005 Ohuchi ..... B21J 15/043 29/243.523
2006/0069382 A1 * 3/2006 Pedersen ..... A61K 9/0004 604/890.1
2006/0122556 A1 * 6/2006 Kumar ..... A61B 1/015 604/67
2006/0122557 A1 * 6/2006 Kumar ..... A61B 1/015 604/67
2006/0157954 A1 * 7/2006 Chen ..... B62K 25/08 280/276
2007/0021713 A1 * 1/2007 Kumar ..... A61M 3/0258 604/27
2007/0219066 A1 * 9/2007 Wang ..... 482/54
2008/0091061 A1 * 4/2008 Kumar ..... A61B 1/00068 600/104
2008/0105234 A1 5/2008 Yoshizumi et al.
2008/0230248 A1 9/2008 Niu
2009/0322054 A1 * 12/2009 Becker ..... B62K 25/08 280/276
2010/0024760 A1 * 2/2010 Ochiai ..... F01M 11/0004 123/195 R
2010/0170390 A1 * 7/2010 Abe ..... F16J 15/164 92/169.1
2010/0183448 A1 7/2010 Leugemors et al.
2012/0138328 A1 * 6/2012 Teipel et al. ..... 173/207
2015/0122117 A1 * 5/2015 Jonsson ..... E21B 1/02 92/165 R

FOREIGN PATENT DOCUMENTS

CN 101398085 A 4/2009
EP 0 648 915 4/1995
JP 07-214479 8/1995
JP 2003-505258 2/2003
WO WO 2008/095073 8/2008
WO WO 2010012390 A1 * 2/2010

* cited by examiner

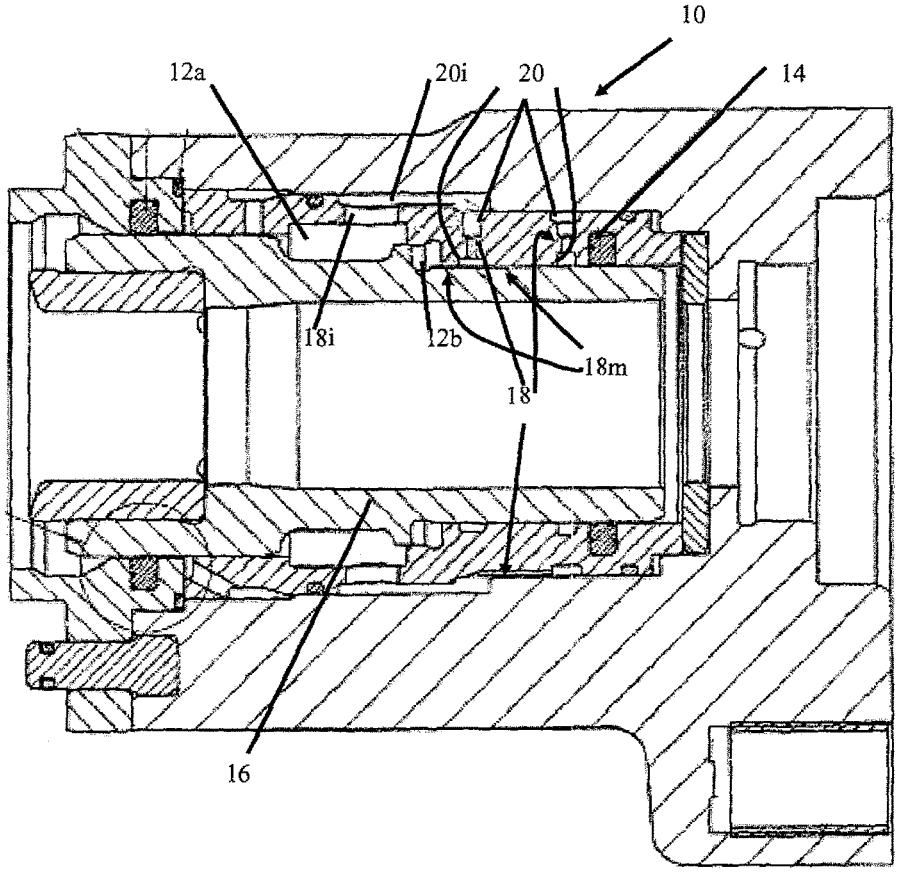
10
12a
20i
20
14
18i
12b
18m
18
16

ROCK DRILLING MACHINE AND USE THEREOF FOR HINDERING OCCURRENCE AND SPREADING OF CAVITATION BUBBLES

TECHNICAL FIELD

The present invention concerns a rock drilling machine and a method to hinder the occurrence and spreading of cavitation bubbles in a rock drilling machine.

BACKGROUND OF THE INVENTION

Cavitation is the occurrence of cavities (voids) in liquids in the form of bubbles where the liquid has transformed into a gas when the static pressure in the liquid has decreased. Cavitation is a mixture of gas formation, the release of trapped air in the liquid and the expansion of air bubbles contained in the liquid.

In cases where the cavitation bubbles implode when the static pressure increases, a very thin jet stream with large force can be formed from the bubble which can damage solid surfaces in the vicinity. A blister forms in a low pressure zone and adheres to a solid surface and implodes when the surrounding static pressure increases. The effect is the same as thousands of sharp nails hammering the surface with a large force whereby the material's ultimate tensile strength can be exceeded, which eventually gives rise to a visible loss of material, often leaving thousands of small craters in the material. This is a known phenomenon in hydraulic rock drilling machines.

Cavitation occurs for example in the area around the damper piston, i.e. the component that forces the adapter/drilling steel/bore crown against the rock so that joints can be tightened between impacts, when the damper piston moves forwards and thereby quickly increases the volume between the damper piston and the damper chamber or the machine body. This problem is usually combatted using a one way valve that fills the volume with oil in order to decrease the occurrence of cavitation bubbles (see U.S. Pat. No. 4,993,504). When the damper piston moves forwards, a substantial pressure decrease occurs which leads to cavitation if the oil cannot be replaced at the same rate as the volume increases. Cavitation bubbles therefore occur since the hydraulic pressure is low and the pressure decrease propagates through all hydraulically connected spaces. Oil starts to flow to the area with the lowest pressure from all possible directions. Cavitation bubbles can thereby spread to and/or also occur in places other than in the original space between the damper piston and the damper chamber (machine body. The low pressure causes the oil from surrounding spaces to flow to the low pressure area to re-establish mean pressure in the damper device. For this reason many drilling machines often have a damper accumulator so that a large volume of oil is readily available to even out the hydraulic pressure, but this is not sufficient to solve the cavitation problem. When the cavitation bubbles finally collapse there is an obvious risk that some of them will be located in the vicinity of sensitive components and will for example damage seals.

SUMMARY OF THE INVENTION

An aim of the present invention is to provide a rock drilling machine that hinders the spreading of already created cavitation bubbles, and filters the pressure decrease so that new cavitation bubbles do not occur in other volumes.

This aim is achieved by a rock drilling machine that comprises a piston that is arranged to move back and forth in a chamber when the rock drilling machine is in use, a cavitation-sensitive component and an oil channel that is arranged to extend between the chamber and said cavitation-sensitive component. The oil channel comprises a series of restrictions and oil volumes, i.e. spaces where oil can collect, in order to hinder the movement of cavitation bubbles through said oil channel.

The movement of oil from the spaces hydraulically connected to the chamber is hindered when a pressure decrease occurs in the chamber. The spread and the occurrence of cavitation bubbles is therefore limited to the chamber itself, whose material is resistant to cavitation damage. Such a solution requires no components with moveable parts and it does not for example require the use of a relatively expensive one way valve, which additionally takes up valuable space in the rock drilling machine.

According to an embodiment of the invention said series of restrictions and oil volumes at least includes two restrictions and one oil volume, or at least three restrictions and two oil volumes, etc. Alternatively, said series of restrictions and oil volumes includes one restriction and two oil volumes, two restrictions and three oil volumes etc.

Said series of restrictions can however include as many restrictions and oil volumes as desired so that the oil channel between the chamber and the cavitation-sensitive component is as long as possible. According to an embodiment of the invention said series of restrictions and oil volumes comprises alternating restrictions and oil volumes so that the pressure decrease that is formed in the chamber is filtered and does not propagate fully to the cavitation-sensitive component, and the flow of oil in the opposite direction is suppressed. The combination of the alternating restrictions and oil volumes in series provides a filter function and a smoother pressure profile adjacent to cavitation-sensitive components in the rock drilling machine.

According to another embodiment of the invention said restrictions are arranged to decrease the cross sectional area of said oil channel by at least 50%, at least 60%, at least 70%, at least 80% or at least 90% or more. It should be noted that the expression "restriction" in this document is intended to include even a gap between adjacent components of the rock drilling machine through which gap oil can for example be sucked into the chamber when a low pressure occurs in the chamber.

According to a further embodiment of the invention at least one restriction is arranged exactly adjacent to the chamber, i.e. where the oil channel meets the chamber.

According to an embodiment of the invention said cavitation-sensitive component of the rock drilling machine is a seal or a guide, such as a bronze guide.

According to another embodiment of the invention said piston is a damper piston, or a piston in the percussion- or breaker part of the rock drilling machine.

According to a further embodiment of the invention the rock drilling machine comprises a plurality of cavitation-sensitive components and/or a plurality of oil channels that are arranged to extend between one or more chambers to one or more cavitation-sensitive components. According to an embodiment of the invention at least one, a plurality, or all of the chambers of the rock drilling machine are substantially isolated from the spaces hydraulically connected to the chamber. Cavitation-sensitive components are consequently isolated from cavitation and are thereby protected from cavitation damage.

According to an embodiment of the invention the total length of said oil channel (measured from the chamber to the cavitation-sensitive component along the oil channel from one end of the oil channel to the other end of the oil channel) is longer than the shortest distance between the chamber and the cavitation-sensitive component (measured from one end of the oil channel to the other end of the oil channel), at least 50% longer, at least 60% longer, at least 70% longer or even longer.

The present invention also concerns a method to hinder the occurrence and spreading of cavitation bubbles of a rock drilling machine. The method comprises the step of arranging an oil channel that is arranged to extend between a piston chamber and a cavitation-sensitive component of the rock drilling machine to comprise a series of restrictions and oil volumes to hinder the movement of cavitation bubbles through said oil channel.

According to an embodiment of the invention said series of restrictions and oil volumes includes at least two restrictions and one oil volume or at least three restrictions and two oil volumes.

According to another embodiment of the invention said series of restrictions and oil volumes comprises alternating restrictions and oil volumes, or consists of alternating restrictions and oil volumes.

According to further embodiment of the invention said restrictions are arranged to decrease said oil channel's cross sectional area by at least 50%, at least 60%, at least 70%, at least 80% or at least 90% or more.

According to an embodiment of the invention at least one restriction is arranged exactly adjacent to the chamber.

According to another embodiment of the invention said cavitation-sensitive component of the rock drilling machine is a seal or a bronze guide.

According to a further embodiment of the invention said piston is a damper piston or a piston in the percussion or breaker part of the rock drilling machine.

BRIEF DESCRIPTION OF THE DRAWING

In the following, the present invention will be described in more detail with reference to the accompanying schematic drawing, in which:

FIG. 1 shows part of a rock drilling machine according to an embodiment of the present invention.

It should be noted that the drawing has not necessarily been drawn to scale and that the dimensions of certain elements may have been exaggerated for the sake of clarity.

DETAILED DESCRIPTION OF EMBODIMENTS

FIG. 1 shows part of a rock drilling machine 10 according to an embodiment of the present invention. The rock drilling machine 10 comprises a damper piston 16 that is arranged to move back and forth in a chamber, which in FIG. 1, due to the damper piston's position in the chamber, is divided into a front part 12*a*, and a rear part 12*b*. A seal 14 is arranged at a distance from the chamber 12*a*, 12*b* around the damper piston 16.

In the illustrated embodiment the rock drilling machine comprises a first oil channel that comprises a first restriction 18*i*, a dedicated constriction or obstruction, in order to hinder the passage of cavitation bubbles between the front part of the chamber 12*a* and the oil volume 20*i*.

As can be seen in FIG. 1 there is a plurality of interconnected oil channels through which oil can flow from oil volumes 20 in the rock drilling machine between the seal 14 and the chamber 12*a*, 12*b*. These oil channels comprise a series of alternating restrictions 18 and oil volumes 20 which hinder the spreading of cavitation bubbles between the seal 14 and the chamber 12*a*, 12*b* when a low pressure occurs in the chamber. The spreading and the occurrence of cavitation bubbles is therefore limited to the chamber 12*a*, 12*b* itself, whose material is resistant to cavitation damage. In the illustrated embodiment the chamber 12*a*, 12*b* is substantially isolated from all of the spaces 20 hydraulically connected to the chamber. Cavitation-sensitive components, such as the seal 14, are consequently isolated from cavitation and are thereby protected from cavitation damage.

It is favourable if the oil channel that includes a series of restrictions 18, 18*i* and oil volumes 20, 20*i* has a long extension, i.e. that its total length (measured from the chamber 12 to the seal 14 along the oil channel) is longer than the shortest distance between the chamber 12 and the seal 14 (measured from one end of the oil channel to the other end of the oil channel), at least 50% longer, at least 60% longer, at least 70% longer or even longer. A long extension can be achieved for example by the placement of oil volumes 20, 20*i* and restrictions 18, 18*i*. A long oil channel gives a long signal time for the pressure decrease and the cavitation bubbles/pressure decrease is/are forced to pass through a larger amount (volume) of oil between the chamber 12 and the seal 14.

According to an embodiment of the invention a restriction 18, i.e. a dedicated' constriction or obstruction, is arranged to decrease an oil channel's cross sectional area by at least 50%, at least 60%, at least 70%, at least 80% or at least 90% or more. It should be noted that the expression "restriction" is intended to also include a gap 18*m* between adjacent components of the rock drilling machine.

The illustrated embodiment shows a damper piston 16. The present invention can however be used on another piston of the rock drilling machine, for example a piston in the percussion or breaker part of the rock drilling machine such as a percussion piston or a breaker piston.

The present invention also concerns a method to hinder the occurrence and spreading of cavitation bubbles of a rock drilling machine. The method comprises the step of arranging an oil channel that is arranged to extend between a piston chamber and a cavitation-sensitive component of the rock drilling machine to comprise a series of restrictions that decrease an oil channel's cross sectional area by at least 50%, at least 60%, at least 70%, at least 80% or at least 90% or more, and oil volumes to hinder the movement of cavitation bubbles through said oil channel. According to an embodiment of the invention said oil channel is arranged to comprise a series of alternating restrictions and oil volumes.

The invention claimed is:

1. Rock drilling machine (10) comprising a piston that is arranged to move back and forth in a chamber (12*a*, 12*b*) when the rock drilling machine (10) is in use, a cavitation-sensitive component (14), and an oil channel that is arranged to extend between the chamber (12*a*, 12*b*) and said cavitation-sensitive component (14), wherein said oil channel comprises a series of restrictions (18) and spaces (20) for restricting oil flow through said oil channel during decreasing pressure in the chamber (12*a*, 12*b*) to hinder the spreading of cavitation bubbles through said oil channel and to isolate the cavitation-sensitive component from cavitation damage without components having movable parts, said series of restrictions and spaces including at least one space for collecting oil flowing through said oil channel, said at least one space being disposed between two restrictions having decreased cross sectional areas.

2. Rock drilling machine (10) according to claim 1, wherein said series of restrictions (18) and spaces (20) includes at least two restrictions (18) and one space (20), or at least three restrictions (18) and two spaces (20).

3. Rock drilling machine (10) according to claim 1, wherein said series of restrictions (18) and oil volumes (20) comprises alternating restrictions (18) and spaces (20) which are sequentially arranged such that one said restriction is followed by one said space, and said one said space is followed by another said restriction.

4. Rock drilling machine (10) according to claim 1, wherein said restrictions (18) are arranged to decrease said oil channel's cross sectional area by at least 50%.

5. Rock drilling machine (10) according to claim 1, wherein at least one restriction (18) of said series of restrictions is arranged where the oil channel meets the chamber (12*a*).

6. Rock drilling machine (10) according to claim 1, wherein said cavitation-sensitive component of the rock drilling machine (10) is a seal (14) or a guide.

7. Rock drilling machine (10) according to claim 1, wherein said piston is a damper piston or a piston in the percussion or breaker part of the rock drilling machine (10).

8. Rock drilling machine (10) according to claim 1, wherein the total length of said oil channel (measured from the chamber (12*a*, 12*b*) to the cavitation-sensitive component (14) along the oil channel) is longer than the shortest distance between the chamber (12*a*, 12*b*) and the cavitation-sensitive component (14) (measured from one end of the oil channel to the other end of the oil channel), at least 50% longer.

9. Use of a rock drilling machine (10) according to claim 1, to hinder the occurrence and spreading of cavitation bubbles of a rock drilling machine (10) by restricting oil flow through said oil channel by said series of restrictions and spaces of said oil channel.

10. Rock drilling machine (10) according to claim 2, wherein said series of restrictions (18) and spaces (20) comprises alternating restrictions (18) and spaces (20) which are sequentially arranged such that one said restriction is followed by one said space, and said one said space is followed by another said restriction.

11. Rock drilling machine (10) according to claim 2, wherein said restrictions (18) are arranged to decrease said oil channel's cross sectional area by at least 50%.

12. Rock drilling machine (10) according to claim 3, wherein said restrictions (18) are arranged to decrease said oil channel's cross sectional area by at least 50%.

13. Rock drilling machine (10) according to claim 2, wherein said at least one restriction (18) is arranged where the oil channel meets the chamber (12*a*).

14. Rock drilling machine (10) according to claim 3, wherein said at least one restriction (18) is arranged where the oil channel meets the chamber (12*a*).

15. Rock drilling machine (10) according to claim 2, wherein said cavitation-sensitive component of the rock drilling machine (10) is a seal (14) or a guide.

16. Rock drilling machine (10) according to claim 3, wherein said cavitation-sensitive component of the rock drilling machine (10) is a seal (14) or a guide.

17. Rock drilling machine (10) according to claim 2, wherein said piston is a damper piston or a piston in the percussion or breaker part of the rock drilling machine (10).

18. Rock drilling machine (10) according to claim 3, wherein said piston is a damper piston or a piston in the percussion or breaker part of the rock drilling machine (10).

19. Rock drilling machine (10) according to claim 2, wherein the total length of said oil channel (measured from the chamber (12*a*, 12*b*) to the cavitation-sensitive component (14) along the oil channel) is longer than the shortest distance between the chamber (12*a*, 12*b*) and the cavitation-sensitive component (14) (measured from one end of the oil channel to the other end of the oil channel), at least 50% longer.

20. Rock drilling machine (10) according to claim 3, wherein the total length of said oil channel (measured from the chamber (12*a*, 12*b*) to the cavitation-sensitive component (14) along the oil channel) is longer than the shortest distance between the chamber (12*a*, 12*b*) and the cavitation-sensitive component (14) (measured from one end of the oil channel to the other end of the oil channel), at least 50% longer.

* * * * *